US010214927B2

(12) United States Patent
Jenner

(10) Patent No.: US 10,214,927 B2
(45) Date of Patent: Feb. 26, 2019

(54) BUILDING SYSTEM

(71) Applicant: Up First Construction Systems Pty Ltd., Greenfields, Western Australia (AU)

(72) Inventor: Philip Edward Jenner, Mandurah (AU)

(73) Assignee: Up First Construction Systems Pty Ltd., Greenfields (AU)

( * ) Notice: Subject to any disclaimer, the term of this patent is extended or adjusted under 35 U.S.C. 154(b) by 522 days.

(21) Appl. No.: 14/773,050

(22) PCT Filed: Mar. 10, 2014

(86) PCT No.: PCT/AU2014/000224
§ 371 (c)(1),
(2) Date: Sep. 4, 2015

(87) PCT Pub. No.: WO2014/134684
PCT Pub. Date: Sep. 12, 2014

(65) Prior Publication Data

US 2016/0010349 A1 Jan. 14, 2016

(30) Foreign Application Priority Data

Mar. 8, 2013 (AU) ..... 2013900823

(51) Int. Cl.
*B66F 5/02* (2006.01)
*E04G 23/06* (2006.01)
(Continued)

(52) U.S. Cl.
CPC ..... *E04G 23/065* (2013.01); *B66F 3/00* (2013.01); *B66F 3/08* (2013.01); *B66F 3/46* (2013.01);
(Continued)

(58) Field of Classification Search
CPC .. B66F 5/02; B66F 7/0608; B66F 9/08; B66F 9/20
See application file for complete search history.

(56) References Cited

U.S. PATENT DOCUMENTS 3,385,401 A * 5/1968 Campbell ..... B66B 9/16 187/222
3,844,535 A * 10/1974 Dorough, Jr. ..... B66F 3/16 254/103
(Continued)

FOREIGN PATENT DOCUMENTS

JP 37-016213 Y 7/1962
JP 51-018053 A 2/1976
(Continued)

OTHER PUBLICATIONS

Extended European Search Report issued in European Patent Application No. 14 76 0790.7, dated Jan. 16, 2017, 9 pages.
(Continued)

*Primary Examiner* — Lee D Wilson
(74) *Attorney, Agent, or Firm* — Hamre, Schumann, Mueller & Larson, P.C.

(57) ABSTRACT

A building system for fabricating a multi-storey building structure, the system comprising at least one first building structure and at least one second building structure and a way for elevating the second building structure to allow provision of the first building structure under the elevated building structure. A method for fabricating a multi-storey building structure, the method comprises the steps of providing a second building structure; elevating the second building structure; providing a first building structure under the elevated second building structure; and lowering the second building structure onto the first building structure.
(Continued)

There is also provided the elevating means, such as jacks for elevating the building structure.

15 Claims, 7 Drawing Sheets

(51) Int. Cl.
*E04G 21/16* (2006.01)
*E04B 1/35* (2006.01)
*B66F 3/08* (2006.01)
*B66F 3/46* (2006.01)
*B66F 3/00* (2006.01)

(52) U.S. Cl.
CPC ..... *E04B 1/3522* (2013.01); *E04G 21/16* (2013.01); *E04G 21/163* (2013.01); *E04G 23/06* (2013.01)

(56) References Cited

U.S. PATENT DOCUMENTS 3,861,647 A * 1/1975 Meredith ..... B66F 3/00 254/387
3,863,418 A 2/1975 Faucheux
3,891,184 A * 6/1975 Fields ..... B66F 3/00 254/387
3,970,171 A 7/1976 Honecker et al.
4,508,316 A * 4/1985 Millard ..... B66F 3/00 254/387
4,626,138 A * 12/1986 Boyes ..... E02D 7/20 254/29 R
5,397,211 A * 3/1995 Lloyd ..... B65G 1/0407 104/246
5,697,597 A * 12/1997 Goodbold ..... B60P 3/12 254/131
5,855,360 A * 1/1999 Wurdack ..... B66F 3/08 254/100
7,448,598 B1 * 11/2008 Elmlinger ..... B66D 1/28 254/338
7,458,562 B1 * 12/2008 Chen ..... B66F 3/10 254/103
2002/0134970 A1 * 9/2002 Bressner ..... B66F 9/06 254/4 R
2008/0129029 A1 6/2008 Holte
2009/0188177 A1 7/2009 Wensel et al.
2010/0207079 A1 * 8/2010 Kooima ..... B66F 3/46 254/1
2012/0181494 A1 7/2012 Guyard
2016/0010349 A1 * 1/2016 Jenner ..... E04G 23/065 52/126.1

FOREIGN PATENT DOCUMENTS

JP 63-110485 U 7/1988
JP 2-013098 U 1/1990
JP 4-128472 4/1992
JP 4-128472 A 4/1992
JP 6-101280 A 4/1994
JP 6-076289 U 10/1994
JP 2003-073082 A 3/2003
JP 2013-002270 A 1/2013
NZ 550438 12/2008

OTHER PUBLICATIONS

Notification of Reasons for Refusal issued in Japanese Patent Application No. 2015-560494, dated Jan. 16, 2018, 4 pages.

* cited by examiner

BUILDING SYSTEM

TECHNICAL FIELD

The present invention relates to building structures and their construction methods.

The invention has been devised particularly, although not necessarily solely, in relation to a building structure to be assembled on site, and in particular building structure having more than one storey.

BACKGROUND ART

The following discussion of the background art is intended to facilitate an understanding of the present invention only. The discussion is not an acknowledgement or admission that any of the material referred to is or was part of the common general knowledge as at the priority date of the application.

The construction of multi-storey building structures is a cumbersome and time consuming task. This is especially true due to the need of installing scaffolds. Moreover, working on scaffolds presents security issues which affect the safety of the personnel fabricating the multi-storey building structures. All these factors increase the costs for the fabrication of multi-storey buildings.

It is against this background that the present invention has been developed.

SUMMARY OF INVENTION

According to a first aspect of the invention there is provided a multi-storey building structure comprising a first storey and a second storey, the first storey being located under the second storey, wherein the second storey is adapted to be elevated for provision of the first storey under the second storey.

Preferably, the first storey comprises a first building structure fabricated on site. In an arrangement, the first storey is fabricated on site and moved under the elevated second storey. In another arrangement, the first storey is fabricated under the elevated second storey.

In a further arrangement, the first storey comprises a prefabricated first building structure which is delivered to site and moved under the elevated second storey.

Preferably, the first storey comprises a ground level first building structure.

Preferably, the second storey comprises a second building structure fabricated on site prior elevating of the second storey.

In an arrangement, the second storey comprises a prefabricated second building structure which is delivered to site.

In an alternative arrangement, the multi-storey building structure compromises a plurality of elevated second storeys and a first storey, wherein the second storeys are each mounted on each other defining an upper section of the multi-storey building structure, the upper section being adapted to be elevated to locate the first storey under the elevated upper section of the multi-storey building structure.

According to a second aspect of the invention there is provided a second building structure adapted to be elevated to locate a first building structure under the second building structure to define a multi-storey building structure.

Preferably, the second building structure comprises means for receiving at least one force for elevating of the second building structure.

Preferably, the means for receiving the force comprises at least one beam.

Preferably, the beam is attached to a lower portion of the second building structure. In an arrangement, the beam is attached to the bottom of the platform.

Preferably, the at least one beam comprises a beam permanently attached to the building structure.

In an alternative arrangement, the beam comprises a temporary beam releasably attached to the building structure.

In an arrangement, the second building structure comprises a platform defining a floor section, the platform comprising a plurality of beams, the beams being adapted to receive at least one force for elevating of the second building structure.

In an arrangement, at least one beam of the plurality of beams may be releasably attached to the bottom of the platform.

According to a third aspect of the invention there is provided a building system for fabricating a multi-storey building structure, the system comprising at least one first building structure and at least one second building structure and means for elevating the second building structure to allow provision of the first building structure under the elevated building structure.

Preferably, the means for elevating the second building structures comprises at least one jack to apply at least one force to the second building structure for elevating thereof.

Preferably, the second building structure comprises a platform defining a floor section, the platform comprising a plurality of beams, the beams being adapted to receive the at least one force for elevating of the second building structure.

In an arrangement, at least one beam of the plurality of beams may be releasably attached to the bottom of the platform.

In an arrangement, the building system comprises a plurality of jacks, each jack being adapted to apply a force to the floor section of the second building structure.

Preferably, there are two pair of jacks spaced apart with respect to each other, the jacks being arranged such that the jacks of each pair of jacks are opposite to each other, each jack applying a force to an area of the perimeter of the floor structure.

In an alternative arrangement, there may be at least one jack applying a foce to the bottom of the platform.

Preferably, each jack comprises at least one protrusion extending outward from the jack.

Preferably, the protrusion comprises a support area adapted to receive the beams.

Preferably, operating each jack comprises the step of raising the support area from a lower position to an upper position in order to elevate the second building structure.

Preferably, operating each jack comprises the step of lowering the support area from an upper position to a lower position in order to lower the second building structure.

Preferably, each jack of the plurality of jacks is adapted to be operated independently from each other. This is particularly useful because it allows controlling the elevation and lowering process of the building structure by controlling each of the jacks independently from each other.

Preferably, each jack comprises means for monitoring the distance that the second building structure is located with respect to the ground.

Preferably, each jack comprises means for controlling the speed that the building structure is being elevated or lowered.

Preferably, each jack comprises means for stopping the elevation and lowering process of the building structure.

Preferably, the system for fabricating the multi-storey building structure further comprises a control system adapted to coordinate the elevation and lowering process of the building structure.

Preferably, the operation of each of the jacks is controlled via the control system.

Preferably, the control system comprises display and control means which show an operator all existing changes in process variables during the elevation and lowering process of the building structure. In addition to this, the operator may make adjustments for the different variables in the process, such as increasing or decreasing the speed of the motor, to set the height of the lift platforms, execute an emergency stop (if necessary), and others.

In an arrangement, the control system is adapted to coordinate a plurality of systems for manufacturing multi-storey building structures.

According to a fourth aspect of the invention there is provided a system for displacing a building structure, the system comprising a plurality of means for displacing the building structure, wherein the plurality of means are operated independently from each other.

Preferably, displacing the building structure comprises elevating the building structure from a lower position to an upper position.

Preferably, displacing the building structure comprises lowering the building structure from a lower position to an upper position.

Preferably, each means for displacing the building structure comprises a jack.

Preferably, each jack is adapted to operate independently from each of the other jacks.

Preferably, each jack comprises means for monitoring the distance that the second building structure is located with respect to the ground.

Preferably, each jack comprises means for controlling the speed that the building structure is being elevated or lowered.

Preferably, each jack comprises means for stopping the elevation and lowering process of the building structure.

Preferably, the system for displacing a building structure further comprises a control system adapted to coordinate the elevation and lowering process of the building structure.

Preferably, the operation of each of the jacks is controlled via the control system.

Preferably, the control system comprises display and control means which show an operator all existing changes in process variables during the elevation and lowering process of the building structure. In addition to this, the operator may make adjustments for the different variables in the process, such as increasing or decreasing the speed of the motor, to set the height of the lift platforms, execute an emergency stop (if necessary), and others.

According to a fifth aspect of the invention there is provided a method for fabricating a multi-storey building structure, the method comprises the steps of:

providing a second building structure;

elevating the second building structure;

providing a first building structure under the elevated second building structure; and lowering the second building structure onto the first building structure.

Preferably, the step of providing the second building structure comprises erecting the second building structure on site.

Preferably, the steps of elevating the second building structure comprises attaching at least on jack to the second building structure and operating the jack to elevate the second building structure.

Preferably, the steps of lowering the second building structure comprises operating the at least one jack to lower the second building structure and removal of the jack after having lowered the second building structure.

Preferably, the step of providing the first building structure comprises erecting the first building structure under the second building structure.

Preferably, the method comprises operating a plurality of jacks for elevating or lowering the second building structure.

Preferably, the method comprises operating each of the jacks independently from each other to elevate or lower the building structure.

According to a sixth aspect of the invention there is provided a jack for displacing a building structure, the jack comprising a central mast having an inner core and an outer shell adapted to slide along the inner core, means for sliding the outer shell along the inner core to selectively displace the jack between a contracted condition and an extended condition, a carriage adapted to slide along the outer shell, and means for selectively displacing the carriage between a first location and a second location of the outer shell, wherein the means for selectively displacing the carriage are operated by the outer shell during sliding of the outer shell along the inner core.

Preferably, the means for sliding the outer shell along the inner core comprises a leadscrew adapted to rotate and nut means screwed onto the leadscrew, the nut means operatively attached to the outer shell such that during rotation of the lead screw, the nut is displaced from a first location to a second location of the lead screw allowing sliding of the outer shell along the inner core.

Preferably, means for selectively displacing the carriage comprises at least one cable having a first end attached to a lower portion of the inner core and a second end attached to the carriage, wherein a location of the cable between the first and second ends is slideably attached to the outer shell such that during displacement of the outer shell along the inner core the carriage is displaced along the outer shell.

Preferably, the outer shell comprises a pulleys system for attachment of the location of the cable to the outer shell.

Preferably, the pulley system comprises a pair of pulleys located adjacent to each other.

Preferably, the pulley system is attached to an upper portion of the outer shell.

Preferably, there are two cables located at each side of the outer shell, each cable having a first end attached to a lower portion of the inner core and a second end attached to the carriage, wherein a location of each cable between the first and second ends is slideably attached to one side of the outer shell.

Preferably, there are two pulley system located at each side of the outer shell.

Preferably, the jack further comprises a motor for providing a rotational force, and a gear box for transferring the rotary force to the lead screw for rotation thereof.

Preferably, the jack comprises means for operation of the jack independently from any other jack of an arrangement of jacks during operation of the arrangement of jacks.

Preferably, the jack further comprises a rotary encoder for monitoring the distance that the second building structure is located with respect to the ground.

Preferably, the jack further comprises means for controlling the speed that the building structure is being elevated or lowered.

Preferably, the jack comprises means for stopping the elevation and lowering process of the building structure.

Preferably, each jack comprises communication means to communicate with a system for controlling the operation of the arrangement of jacks.

Preferably, the jack comprises means for attaching a structure to be displaced, the means comprising a protrusion extending outward from the carriage.

Preferably, the protrusion is adapted to receive a beam.

Preferably, the jack further comprises means for attaching the jack to the ground.

Preferably, the means for attaching the jack to the ground comprises a base plate.

BRIEF DESCRIPTION OF THE DRAWINGS

Further features of the present invention are more fully described in the following description of several non-limiting embodiments thereof. This description is included solely for the purposes of exemplifying the present invention. It should not be understood as a restriction on the broad summary, disclosure or description of the invention as set out above. The description will be made with reference to the accompanying drawings in which.

DESCRIPTION OF EMBODIMENTS

Figure 1:
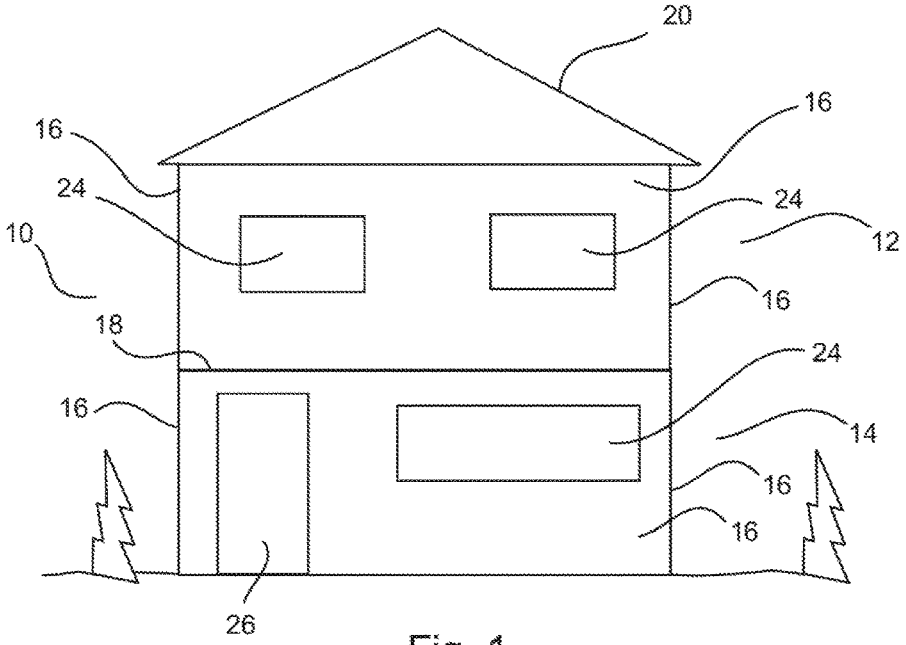
FIG. 1 is a front view of a building structure in accordance to an embodiment of the present invention.

FIG. 1 shows a schematic view of a multi-storey building structure 10 according to a first embodiment of the present invention. The building structure 10 includes an upper building structure 12 and a lower building structure 14. The upper building structure 12 comprises a plurality of walls 16 spaced apart from each other and extending on a platform 18 so as to define living areas. A roof structure 20 rests on the plurality of walls 16 to isolate the living areas 46 from the environment. The platform 18 defines the floor of the upper building structure 12 of the building structure 10.

The upper building structure 12 of the building structure 10 is supported on the lower building structure 14. The lower building structure 14 comprises also as the upper building structure 12 a plurality of walls 16 spaced apart from each other and extending on a platform 22 to define living areas of the lower portion. The platform 22 rest on the ground which supports the multi-storey building structure 10.

The upper building structure 12 comprises windows 24 to allow entrance of air into the living areas and viewing outside of the living areas. The lower building structure 14 comprises a window 24 and a door 26 to provide access to the interior of the building structure 10.

The process of fabricating the building structure 10 comprises the steps of providing the upper building structure 12 and elevating the second building structure. After the building structure has been elevated the lower building structure may be provided under the upper building structure 12 and the upper building structure 12 may be lowered onto the lower building structure 14.

FIGS. 2 to 5 show the process of fabricating the multi-storey building structure 10.

Figure 2:
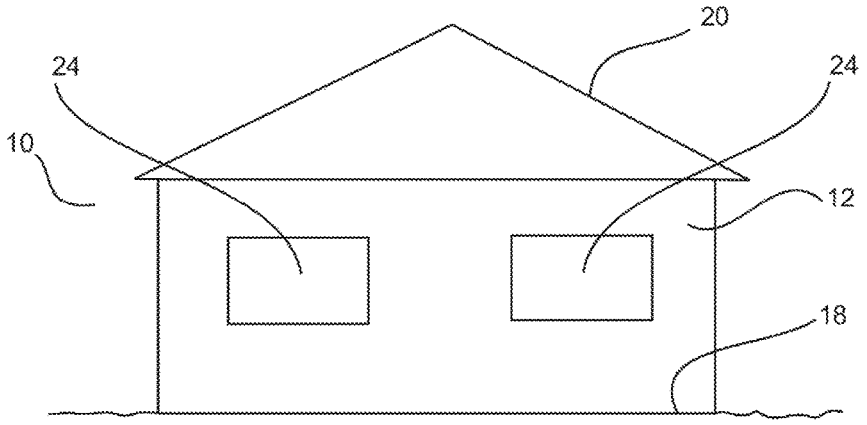
FIGS. 2 to 5 show the steps of a method for erecting the building structure shown in FIG. 1.

FIG. 2 shows the upper building structure 12. The building structure 12 may be a pre-fabricated building structure 12 which has been delivered to the constructions site. Alternatively, the building structure 12 may be erected on site 12.

As mentioned before, the upper building structure 12 comprises a platform 18 defining the floor section of the upper building structure 12. The platform 18 comprises a plurality of beams. The beams are adapted for receiving at least one force for elevating of the second building structure. Alternatively, upper building structure may comprise means for receiving lifting means. These means may be attached adjacent to the lower portion of the upper building structure. In an arrangement these means comprise beams. The beams may be beams which permanently form part the platform. In other arrangement, these means may also include temporary beams which are releasably attached to the building structure. In a particular arrangement, the temporary beams may be attached to the bottom of the platform.

After provision of the upper building structure 12, the building structure 12 is elevated. This is accomplished via the lifting means 28. In the arrangement, shown in FIG. 3 the lifting means comprises a plurality of jacks 30 in accordance to an embodiment of the invention.

Figure 3:
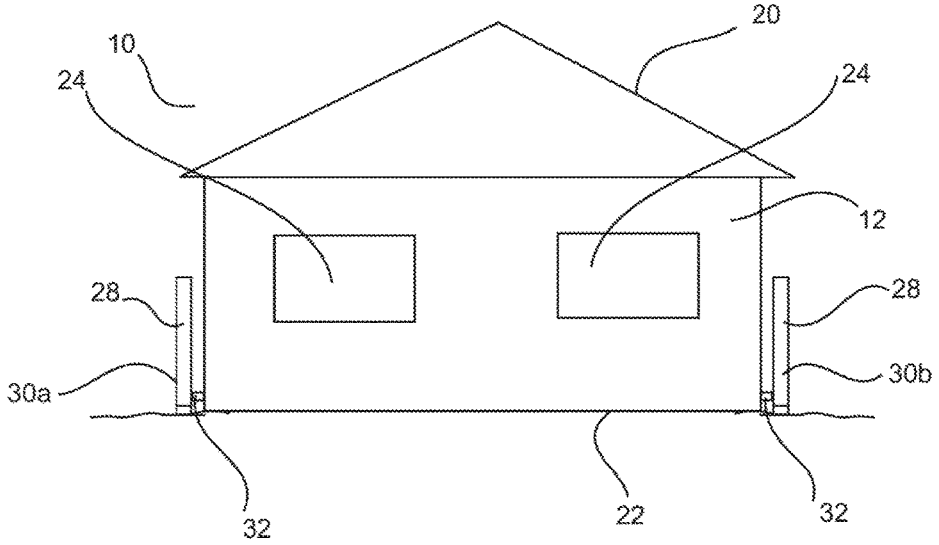

As shown in FIG. 3, the jacks 30 are adapted to be attached to the sides of the upper building structure 12 such as to apply a lifting force to the upper building structure 12. As will be described in greater detail when describing the jacks 30, a particular arrangement of jacks 30 in accordance with an embodiment of the invention comprises a support area 32 which is adapted to be received by the beams defining the floor structure or by the means for receiving lifting means which are attached to the bottom portion of the upper building structure.

In the arrangement, shown in FIG. 3, there are two pair of jacks 30*a* and 30*b* spaced apart with respect to each other, the jacks 30 being arranged such that the jacks 30*a* and 30*b* of each pair of jacks are opposite to each other. The FIG. 3 shows only a first pair of jacks 30*a* and 30*b*. However, a second pair of jacks (not shown) are located adjacent the first pair of jacks 30 and 30*b*. The second pair of jacks is attached to the rear portion of the upper building structure 12 which is not shown in FIG. 3.

In an alternative arrangement, there are also incorporated one or more jacks 30 underneath the platform 18 which in conjuction with the jack 30 which are attached to the sides of the building structure 12 elevate the building structure 12. The one or more jacks 30, which are incorporated underneath the platform 18 apply a force to the beams which are attached to the bottom of the platform 18.

After attachment of the jacks 30 to the upper building structure 12, the upper building structure 12 is elevated to an elevated condition.

Figure 4:
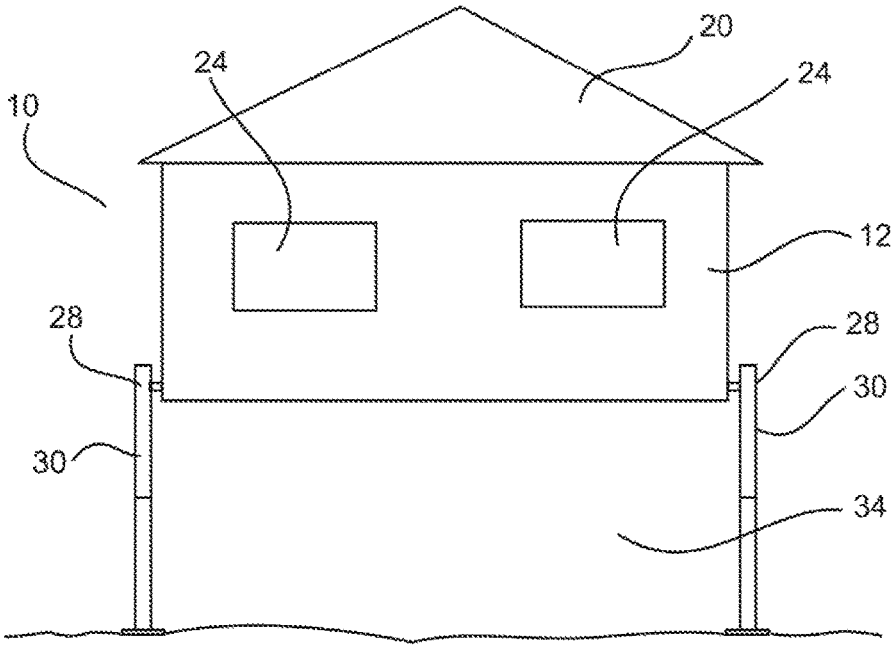

FIG. 4 shows the upper building structure 12 in the elevated condition. As shown in FIG. 4, after elevating the upper building structure 12 a void space 34 is defined under the upper building structure 12. The void space 34 allows provision of the lower building structure 12 so as to finalise fabrication of the multi-storey building structure 10.

Figure 5:
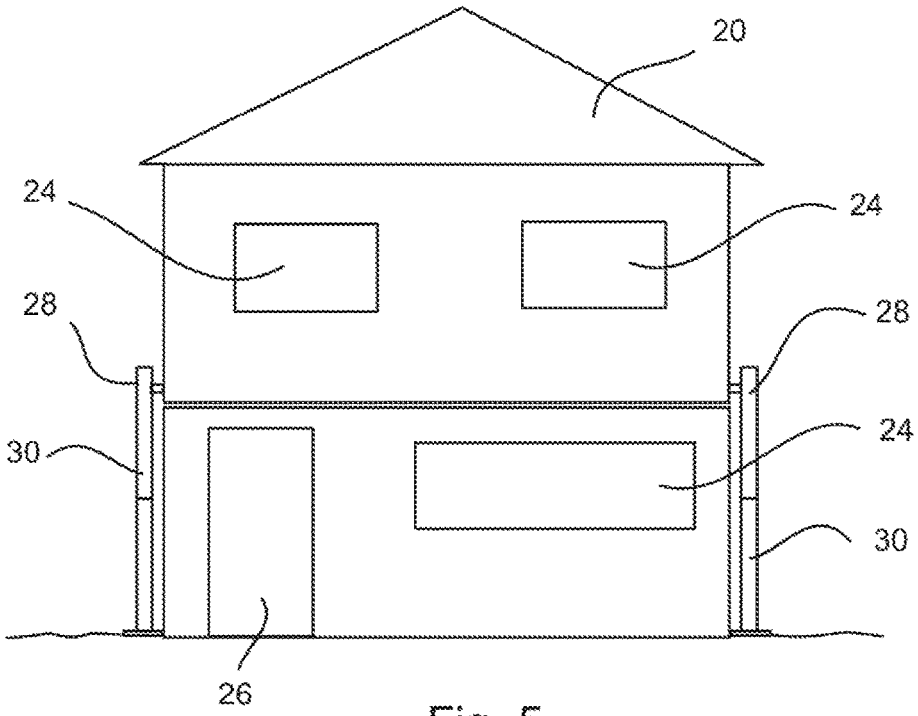

As shown in FIG. 5, the lower building structure 14 is provided under the upper building structure 12 in the void space 34. The lower building structure 14 may be fabricated under the upper building structure 12. Alternatively, the lower building structure 14 may be a pre-fabricated building structure 12 which has been delivered to the constructions site and located under the upper building structure 12. Another alternative is that lower the building structure 14 may be erected on site and located under the upper building structure 12.

After provision of the lower building structure 14, the upper building structure 12 may be lowered onto the lower building structure 14.

As mentioned before, in accordance with the present embodiment of the invention the upper building structure 12 is elevated via a plurality of jacks 30. FIGS. 6 to 10 show the jack 30 in accordance with an embodiment of the invention.

Figure 6:
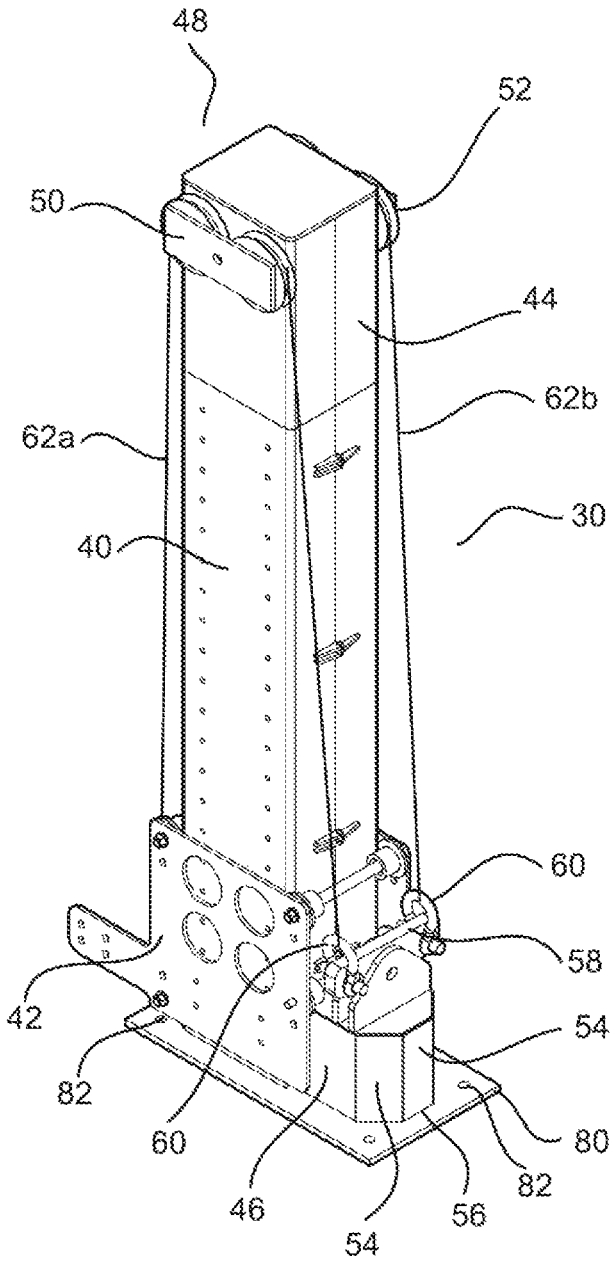
FIG. 6 is perspective view of a jack in accordance with an embodiment of the invention in the contracted condition.

Referring to FIG. 6 showing the jack 30 in the contracted condition, the jack 30 comprises a central mast 40 and a carriage 42. The carriage 42 is adapted to slide along an outer shell 64 of the central mast 40.

The central mast 40 comprises an upper portion 44 and a lower portion 46. The upper portion 44 comprises a pulley system 48. The pulley system 48 comprises a plurality of pulley 50 and 52, each of the plurality of pulleys 50 and 52 are located at opposite sides of the upper portion 44. The lower portion 46 of the central mast 40 comprises an extended section 54. The extended section 54 comprises an anchor hinge lug 56 for attachment of a fastening plate 58 having a pair of shackles 60.

Cables 62*a* and 62*b* extend from the shackles 60 to the carriage 42 passing over the pulleys 50 and 52. As will be described with reference of the method of operation of the jack 30, the cables 62 force the carriage 42 to slide along the central mast 40.

Figure 7:
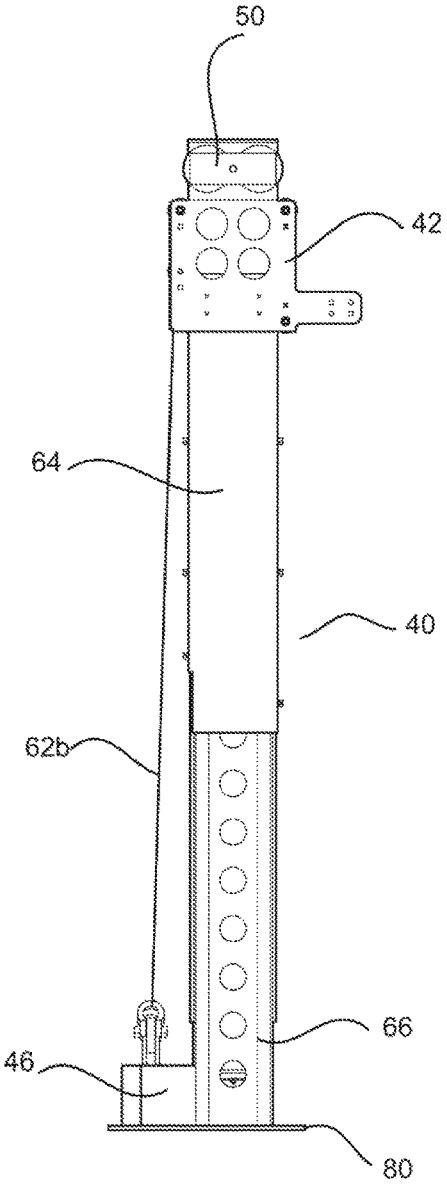
FIG. 7 is a side view of the jack shown in FIG. 6 in the extended condition.
Figure 8:
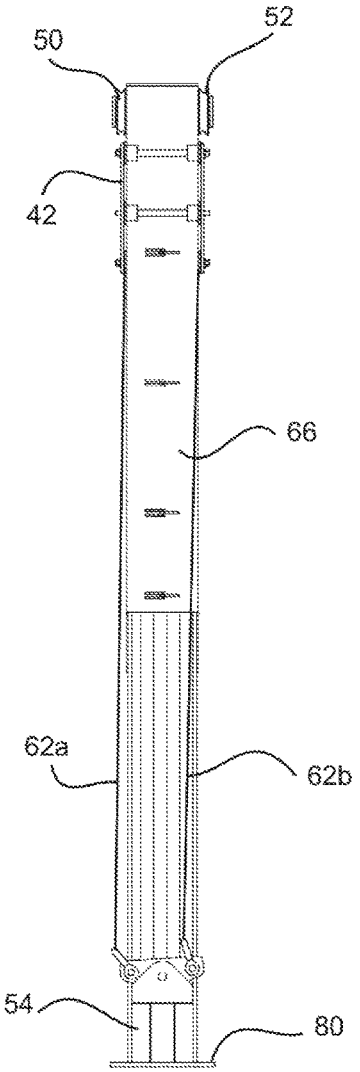
FIG. 8 is a rear view of the jack shown in FIG. 6 in the extended condition.

Referring now to FIGS. 7 and 8 which show the jack 30 in the extended condition, as shown in these figures, the central mast 40 comprises an outer shell 64 and an inner core 66. The outer shell 64 is adapted to slideably receive the inner core 66. In this manner the central mask 40 is of telescopic configuration allowing selectively locating the jack 30 between a contracted condition and an extended condition. As will be described with reference to the method of operation of the jack 30, this permits decreasing or extending the longitudinal dimensions of the central mast 40.

In accordance with the present embodiment of the invention, selective locating the jack 30 between a contracted condition and an extended condition is accomplished via a screw jack type system 70.

Figure 9:
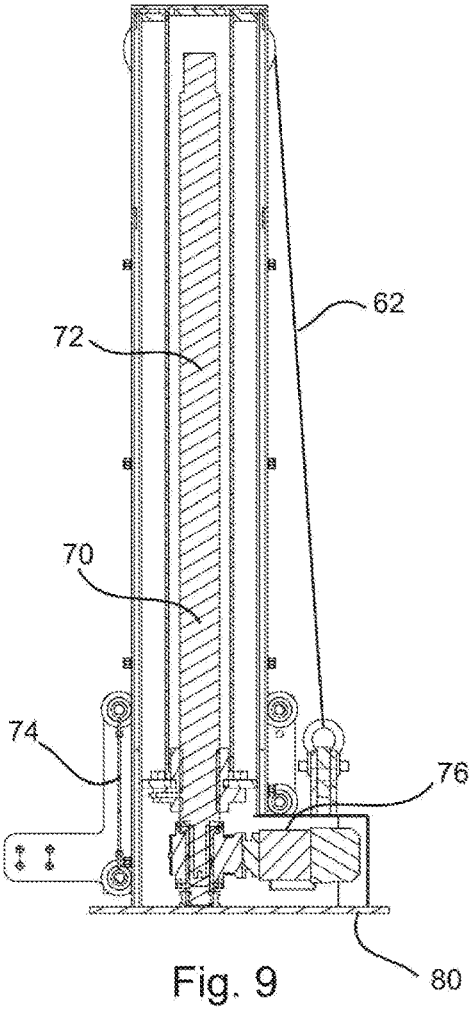
FIG. 9 is a side cross-sectional view of the jack shown in FIG. 6 in the contracted condition.
Figure 10:
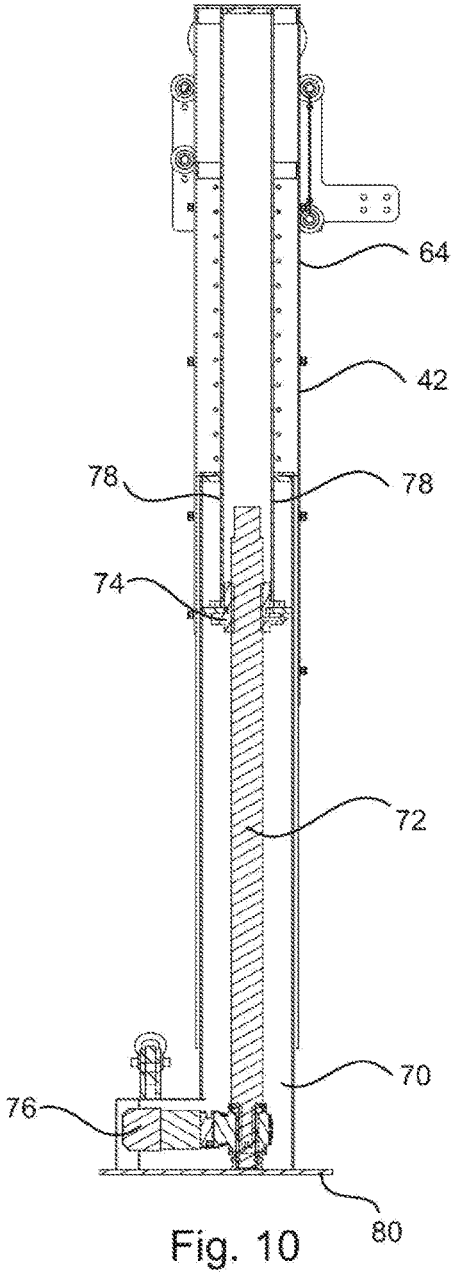
FIG. 10 is a side cross-sectional view of the jack shown in FIG. 6 in the extended condition.

As shown in FIGS. 9 and 10, the screw jack system 70 is included into the central mast 40. In particular, the screw jack type system 70 comprises a leadscrew 72 and a nut means 74. The nut means 74 is adapted to travel along the thread of the leadscrew 72 during rotation of the leadscrew 72.

The screw jack type system 70 comprises a motor/gear box unit 76 which is operatively connected to the leadscrew 72 to transfer rotational movement to the leadscrew 72. In this manner, the displacement of the nut means 74 along the leadscrew 72 is controlled via the motor/gear box unit 76.

As indicated earlier, the outer shell 64 is adapted to slide along the inner core 66 in order to extend the longitudinal dimensions of the jack 30. The movement of the outer shell 64 along the inner core 66 is controlled via the screw jack type system 70. For this, the outer shell 64 is operatively attached to the nut means 74 as shown in, for example, FIG. 10 via plate means 78 which are attached to the inside of the upper portion of the outer shell 64.

Further, as mentioned earlier, the carriage 42 is adapted to slide along the outer shell 64. The movement of the carriage 42 is controlled via the cables 62 which have one end attached to the carriage 42 and the other end to the lower portion of the shackles 60 and passing through the pulleys means 48 (see FIG. 6, for example). This arrangement allows displacement of the carriage 42 along the outer shell 64 as the inner mast 40 of the jack 30 varies its longitudinal dimensions. For example, during sliding of the outer shell 64 along the inner core 66 to increase the length of the jack 30, the carriage 42 is forced via the cables 62 to be displaced from the lower portion of the outer shell 64 to the upper portion of the outer shell 64. In this manner, the jack 30 is displaced from the contracted condition (see FIG. 9) to the extended condition (see FIG. 10). This arrangement is particular useful because it allows extending the effective spread of the jack 30.

The jack 30 is adapted to be fastened to the ground. For this the jack 30 comprises a base plate 80 having openings 82 for fastening the base onto the ground.

Further, the jack 30 comprises means for controlling its operation. In an arrangement in accordance with the present embodiment of the invention, the jack 30 comprises means for controlling the speed of rotation of the leadscrew 72. These means may comprise a variable speed drive. This allows varying the speed of the motor/gear box unit 76 in accordance with the speed required at the time that the operation of elevating and lowering of the building structure is being conducted.

Further, for security reasons the jack 30 may include means for stopping the rotational movements of the motor/gear box unit 76. This allows stopping the elevating process of the building structure if required.

A rotary encoder may be incorporated in the motor/gear box unit 76 of the jack 30. The rotary encoder allows keeping track of the position of the output shaft of the motor/gear box unit 76. This is particularly useful because it allows having an indication of the height (for example, with respect to the ground) where the building structure is located at any particular moment in time during elevation of the building structure.

In a particular arrangement of the present embodiment of the invention, there is provided a programmable logic controller (PLC). This controller will be responsible for controlling and monitoring the entire process of elevating and lowering the building structure. The PLC will coordinate the processes carried out by all control elements mentioned above such as the means for controlling the speed of rotation of the leadscrew 72, means for stopping the rotational movements of the motor/gear box unit 76, the rotary encoder.

In an arrangement, the PLC is adapted to control simultaneously elevation of a plurality of building structures. Also, the PLC will allow control of each jack independently from the others. The controller comprises a logic program specifically designed to control of each jack independently from the others. This is particularly useful because the process of elevating the building structure is accomplished by controlling each of the jacks individually with respect to each other. Thus, it is not necessary that operation of a plurality of jacks 30 used for elevating a building structure is controlled by one jack 30 (called the master) which controls and monitors operation of the other jacks 30. One of the reasons that it is not necessary to use a master jack 30 is that each jack 30 includes a rotary encoder which provide information related to the height of the building structure with respect to the ground. Controlling independently each jack 30 avoids the need to provide communication via, for example, cables or lasers between the master jack 30 and the other jacks 30, thus facilitating the process for elevating the second building structure.

Figure 11:
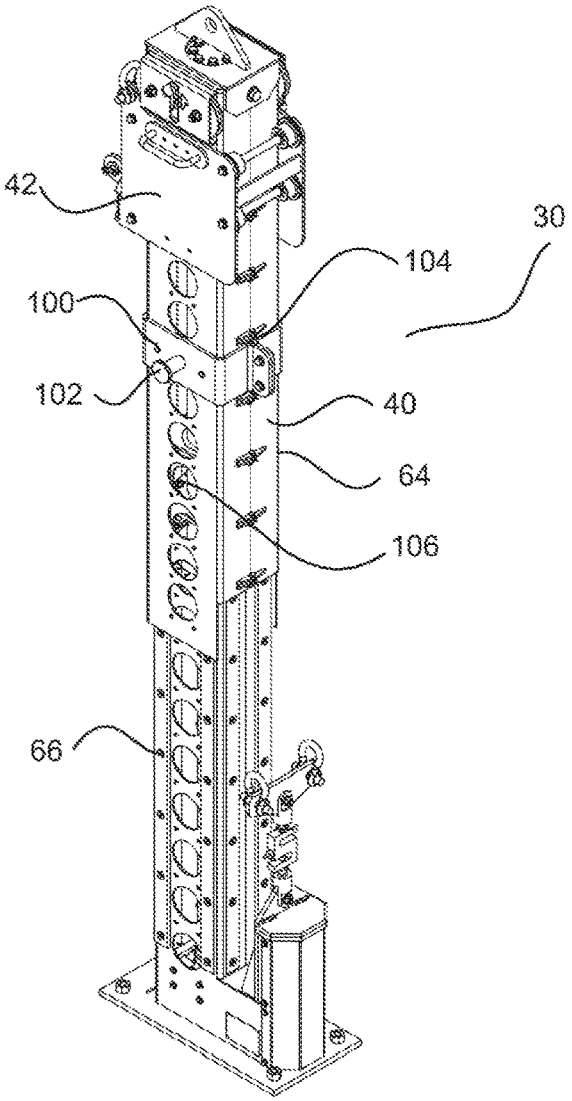
FIG. 11 is perspective view of a jack in accordance with an embodiment of the invention in the contracted condition.

Moreover, there may be provided display and control means which show an operator all existing changes in process variables while the elevating or lowering process is being carried out. In addition to this, the operator may make adjustments for the different variables in the process, such as increasing or decreasing the speed of the motor, to set the height of the lift platforms, execute an emergency stop (if necessary), and others FIGS. 10 and 11 show a jack 30 according to a second embodiment of the invention. The jack according to the second embodiment is similar to the jack of the first embodiment and similar reference numerals are used to identify similar parts. The jack 30 in accordance with the second embodiment comprises a fall arrester 100. The fall arrester 100 stops the jack automatically preventing the jack 30 from returning to the contracted condition. The fall arrester 100 in accordance with the second embodiment of the invention is particularly advantageous because it does not require resetting after the fall arrester has been activated.

The fall arrester 100 comprises pins 102 adapted to selectively be displaced from an extended condition to a retracted condition. During the elevation process of the outer shell 64 of the jack the pins are in the extended condition. In any circumstances in which the jack 30 falls into the retracted condition the pins 102 are forced into the retracted condition. The fact that the pins 102 are forced into the retracted condition stops moving of the outer shell of the jack. The circumstances in the pins may be retracted may happen during the elevation process or when the jack 30 is in its extended condition.

Figure 12:
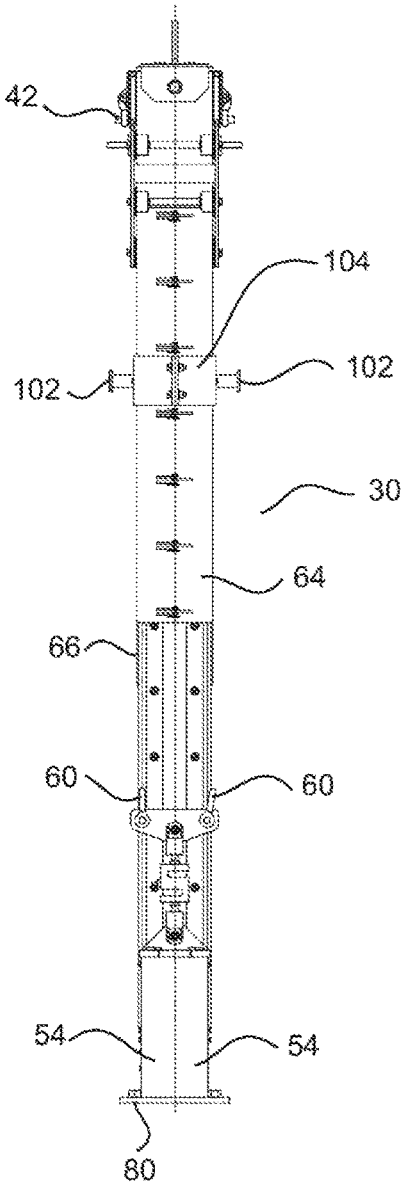
FIG. 12 is side view of the jack shown in FIG. 11.

FIGS. 11 and 12 show the fall arrester 100. The fall arrester 100 comprises a mounting bracket 104 surrounding the outer shell 64. The mounting bracket 104 is fixed to the outer shell 64 of the jack 30. Each pin 102 is slideably attached to each of the sides of the mounting bracket 104. Each pin 102 is adapted to traverse the mounting bracket 104 as well as the outer and inner shell 64 and 66 of the jack 30. In this manner the pins 102, by moving into the retracted condition, stop the downward movement of the outer shell 64 of the jack 30. Retraction of the pin 102 is accomplished by balancing the pins 102 such that the pins 102 move into the retracted condition.

The jack 30 in accordance with the first and second embodiment of the invention comprises load cells for constantly measuring the load applied to the jack. Further, there is provided an alarm which activates when the jacks have been overloaded. Further, there is also provided a control system incorporating programmable logic controllers on each jack 30 and the control panel.

There are also provided means for securing the jack 30 in the extended condition. For example, once the jack 30 reaches the height required a locking pin is inserted in the central mast by an operator before any work is conducted under the load. This jack 30 is adapted such that the pin may be installed at any height locking the position of the load completely.

Modifications and variations as would be apparent to a skilled addressee are deemed to be within the scope of the present invention.

Further, it should be appreciated that the scope of the invention is not limited to the scope of the embodiment disclosed. By way of example, the present embodiment relates to a multi-storey building structure comprising a lower (first) building structure and an upper (second) building structure. However, in accordance with other embodiments of the invention, multi-storey building structure comprising more than two building structures may be fabricated using the method previously described. In these embodiments, the process for fabricating this multi-storey building structure comprises the steps as shown in FIGS. 2 to 5. After fabrication of the multi-storey building structure comprising the first and second building structures and shown in FIG. 5, the multi-storey building structure is elevated using the jacks 30 so as to provide a third lower building structure the first and second building structures. This step of elevating the multi-storey may be repeated in order order to obtain a multi-storey building structure having as many upper building structures as desired.

Further, the jack 30 in accordance with an embodiment of the present invention has been with reference of the elevation or lowering process of a building structure. However, the use of the jack 30 in accordance with an embodiment of the present invention is not limited to elevation or lowering process of a building structures. The jack 30 may be used for elevating or lowering a great variety of structures such as vehicles, for example. It may be also applicable for lifting loads by incorporating the principle of operation of the jack of the present embodiment of the invention into cranes.

Throughout this specification, unless the context requires otherwise, the word "comprise" or variations such as "comprises" or "comprising", will be understood to imply the inclusion of a stated integer or group of integers but not the exclusion of any other integer or group of integers.

The invention claimed is:

1. A collapsible jack for displacing a building structure, the jack comprising:

a central mast having an inner core and an outer shell adapted to slide along the inner core in a telescopic configuration;

a drive system for moving the outer shell along the inner core to selectively displace the jack between a contracted condition and an extended condition;

a carriage slidably mounted on the outer shell; and, a cable and a pulley system for selectively displacing the carriage between a first location and a second location on the outer shell, the pulley system being located at an upper portion of the outer shell wherein, in use, the cable and the pulley system operate to displace the carriage during sliding movement of the outer shell along the inner core.

2. A jack according to claim 1, wherein the cable is one of first and second cables provided on respective sides of the central mast, each cable having one end attached to the carriage and other end anchored to a base of the jack, and the pulley system comprises a plurality of pulleys provided on opposite sides of the upper portion of the outer shell.

3. A jack according to claim 2, wherein a pair of pulleys is provided adjacent to each other, one pair on each side of the upper portion of the outer shell, and one of the first and second cables passes over one of the pair of pulleys respectively.

4. A jack according to claim 1, wherein the drive system for moving the outer shell along the inner core comprises a screw jack type system.

5. A jack according to claim 4, wherein the screw jack type system comprises a lead screw adapted to rotate and a nut screwed onto the lead screw, the nut being operatively attached to the outer shell whereby, in use, during rotation of the lead screw, the nut is displaced from a first location to a second location on the lead screw facilitating sliding movement of the outer shell along the inner core.

6. A jack according to claim 5, wherein the screw jack type system further comprises a motor/gear box unit which is operatively connected to the lead screw to transfer rotational movement to the lead screw.

7. A jack according to claim 1, wherein the carriage comprises a protrusion extending outward from the carriage for lifting a load that is offset with respect to a longitudinal axis of the jack.

8. A collapsible jack for displacing a building structure, the jack comprising a central mast having an inner core and an outer shell adapted to slide along the inner core, means for sliding the outer shell along the inner core to selectively displace the jack between a contracted condition and an extended condition, a carriage adapted to slide along the outer shell, and means for selectively displacing the carriage between a first location and a second location of the outer shell, wherein the means for selectively displacing the carriage are operated by the outer shell during sliding of the outer shell along the inner core and, wherein the means for selectively displacing the carriage comprises at least one cable having a first end attached to a lower portion of the inner core and a second end attached to the carriage, wherein a location of the cable between the first and second ends is slideably attached to the outer shell such that during displacement of the outer shell along the inner core the carriage is displaced along the outer shell.

9. A jack according to claim 8 wherein the means for sliding the outer shell along the inner core comprises a leadscrew adapted to rotate and nut means screwed onto the leadscrew, the nut means operatively attached to the outer shell such that during rotation of the lead screw, the nut is displaced from a first location to a second location of the lead screw allowing sliding of the outer shell along the inner core.

10. A jack according to claim 8 wherein the outer shell comprises a pulley system for attachment of the location of the cable to the outer shell.

11. A jack according to claim 10 wherein the pulley system comprises a pair of pulleys located adjacent to each other.

12. A jack according to claim 10 wherein the pulley system is attached to an upper portion of the outer shell.

13. A jack according to claim 8 wherein there are two cables located at each side of the outer shell, each cable having a first end attached to a lower portion of the inner core and a second end attached to the carriage, wherein a location of each cable between the first and second ends are slideably attached to one side of the outer shell.

14. A jack according to claim 9 wherein the jack further comprises a motor for providing a rotational force, and a gear box for transferring the rotary force to the lead screw for rotation thereof.

15. A jack according to claim 8 wherein the jack comprises means for attaching a structure to be displaced, the means comprising a protrusion extending outward from the carriage for lifting a load that is offset with respect to the longitudinal axis of the jack.

* * * * *